US010100614B2

(12) United States Patent
Forstner et al.

(10) Patent No.: US 10,100,614 B2
(45) Date of Patent: Oct. 16, 2018

(54) AUTOMATIC TRIGGERING AND CONDUCTING OF SWEEPS

(71) Applicants: Ingo Forstner, Ahnsbeck (DE); John D. Macpherson, Spring, TX (US)

(72) Inventors: Ingo Forstner, Ahnsbeck (DE); John D. Macpherson, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 186 days.

(21) Appl. No.: 15/135,833

(22) Filed: Apr. 22, 2016

(65) Prior Publication Data

US 2017/0306724 A1 Oct. 26, 2017

(51) Int. Cl.

| | |
|---|---|
| ***E21B 37/00*** | (2006.01) |
| ***E21B 21/08*** | (2006.01) |
| ***E21B 47/06*** | (2012.01) |

(52) U.S. Cl.

CPC ..... *E21B 37/00* (2013.01); *E21B 21/08* (2013.01); *E21B 47/06* (2013.01)

(58) Field of Classification Search

CPC ..... E21B 37/00

See application file for complete search history.

(56) References Cited

U.S. PATENT DOCUMENTS

| | | | | |
|---|---|---|---|---|
| 457,884 | A | 8/1891 | Tripp | |
| 5,176,285 | A | 1/1993 | Shaw | |
| 5,472,113 | A | 12/1995 | Shaw | |
| 5,609,268 | A | 3/1997 | Shaw | |
| 6,122,873 | A | 9/2000 | Randjelovic | |
| 6,290,001 | B1 * | 9/2001 | West | C09K 8/05 166/312 |
| 6,739,414 | B2 | 5/2004 | Brookey et al. | |
| 7,033,977 | B2 | 4/2006 | Brookey et al. | |

(Continued)

OTHER PUBLICATIONS

Carlsen, et al. "Utilizing Instrumented Stand Pipe for Monitoring Drilling Fluid Dynamics for Improving Automated Drilling Operations", Proceedings for the 2012 IFAC Workshop on Automatic Control in Offshore Oil and Gas Production, May 31-Jun. 1, 2012, Trondheim, Norway; 6 pages.

(Continued)

*Primary Examiner* — William D Hutton, Jr.
*Assistant Examiner* — Steven A MacDonald
(74) *Attorney, Agent, or Firm* — Cantor Colburn LLP

(57) ABSTRACT

Methods and systems for automatically performing a sweep operation in a borehole penetrating an earth formation including conveying a drillstring through a borehole, the drillstring having one or more sensors located thereon, determining that a sweep operation should be performed based on information obtained from the one or more sensors, determining characteristics of a pill to be used for a sweep operation based on information obtained from the one or more sensors, preparing a pill in accordance with the determined characteristics, deploying the pill into the drillstring and conveying the pill through the drillstring, and monitoring the sweep operation while the pill is within the drillstring and verifying the sweep operation. At least one of the determination that a sweep operation should be performed, the determination of the pill characteristics, or the preparation of the pill is performed automatically.

20 Claims, 3 Drawing Sheets

(56) References Cited

U.S. PATENT DOCUMENTS

| | | | | |
|---|---|---|---|---|
| 7,196,786 | B2 | 3/2007 | DiFoggio | |
| 7,520,325 | B2 | 4/2009 | Hocking | |
| 7,784,539 | B2 | 8/2010 | Montaron | |
| 7,795,186 | B2 | 9/2010 | Saini et al. | |
| 7,798,227 | B2 | 9/2010 | Misselbrook | |
| 8,235,120 | B2 | 8/2012 | Quintero et al. | |
| 8,689,869 | B2 | 4/2014 | Shindgikar et al. | |
| 9,097,077 | B2 | 8/2015 | Williamson et al. | |
| 9,228,401 | B2 | 1/2016 | Edwards et al. | |
| 9,291,015 | B2 * | 3/2016 | Coley | E21B 47/06 |
| 2002/0074269 | A1 * | 6/2002 | Hensley | E21B 21/065 209/726 |
| 2003/0102163 | A1 * | 6/2003 | Hemphill | E21B 21/00 175/57 |
| 2004/0060738 | A1 * | 4/2004 | Hemphill | E21B 21/00 175/40 |
| 2004/0256152 | A1 | 12/2004 | Dashevskiy et al. | |
| 2005/0252286 | A1 * | 11/2005 | Ibrahim | E21B 49/005 73/152.55 |
| 2013/0054146 | A1 | 2/2013 | Rasmus et al. | |
| 2014/0041941 | A1 | 2/2014 | Edbury et al. | |
| 2014/0131104 | A1 * | 5/2014 | Coley | E21B 47/06 175/48 |
| 2014/0291023 | A1 * | 10/2014 | Edbury | E21B 44/00 175/24 |
| 2015/0134257 | A1 * | 5/2015 | Erge | E21B 47/00 702/9 |
| 2017/0052101 | A1 * | 2/2017 | Rowe | E21B 47/00 |

OTHER PUBLICATIONS

International Search Report, International Application No. PCT/US2017/028762, dated Jul. 12, 2017, Korean Intellectual Property Office; International Search Report 4 pages.

International Written Opinion, International Application No. PCT/US2017/028762, dated Jul. 12, 2017, Korean Intellectual Property Office; International Written Opinion 10 pages.

* cited by examiner

AUTOMATIC TRIGGERING AND CONDUCTING OF SWEEPS

BACKGROUND

In material or substance recovery from earth formations, drilling operations are performed. During drilling operations, an annulus between a pipe and borehole can become clogged with drill cuttings or otherwise impacted and a cleaning operation may be required to be performed. Such cleaning operations (e.g., hole cleaning) may be referred to as sweep or sweep/pill operations, wherein a high viscosity "pill" is mixed, circulated down the inside of the drillstring, out through a bottom hole assembly, and then back up through the annulus of the borehole. Such operations tend to be time consuming and required multiple operators and/or personnel to control and monitor multiple different aspects of a downhole operation and systems related thereto. Accordingly, performing a sweep operation may be time consuming and potentially inconsistent.

SUMMARY

Methods for automatically performing a sweep operation in a borehole penetrating an earth formation are provided. The methods include conveying a drillstring through a borehole, the drillstring having one or more sensors located thereon, automatically determining that a sweep operation should be performed based on information obtained from the one or more sensors, automatically determining characteristics of a pill to be used for a sweep operation based on information obtained from the one or more sensors, preparing a pill in accordance with the determined characteristics, deploying the pill into the drillstring and conveying the pill through the drillstring and the borehole, and monitoring the sweep operation while the pill is within the drillstring and the borehole and verifying the sweep operation.

Systems for automatically performing a sweep operation in a borehole penetrating an earth formation are provided. The systems include a drillstring configured to be conveyed through a borehole, at least one sensor located on the drillstring configured to monitor a characteristic of a fluid within the drillstring, and a processor configured to perform a sweep operation. The systems are configured to automatically determine that a sweep operation should be performed based on information obtained from the one or more sensors, automatically determine characteristics of a pill to be used for a sweep operation based on information obtained from the one or more sensors, prepare a pill in accordance with the determined characteristics, deploy the pill into the drillstring and conveying the pill through the drillstring and the borehole, and monitor the sweep operation while the pill is within the drillstring and the borehole and verifying the sweep operation.

BRIEF DESCRIPTION OF THE DRAWINGS

The following descriptions should not be considered limiting in any way. With reference to the accompanying drawings, like elements are numbered alike.

The detailed description explains embodiments of the present disclosure, together with advantages and features, by way of example with reference to the drawings.

DETAILED DESCRIPTION

A detailed description of one or more embodiments of the disclosed apparatuses and methods presented herein are presented by way of exemplification and not limitation, with reference made to the appended figures.

Disclosed are methods and systems for performing automatic sweep operations in a downhole system. Various embodiments are provided to enable automatic and/or partially automatic mechanisms related to sweep operations to enable improved and/or more efficient sweep operations. For example, embodiments provided herein can be used to automatically determine when a sweep operation should be performed, automatically determine characteristics of a sweep operation, automatically perform the sweep operation, and/or automatically verify the sweep operation.

Figure 1:
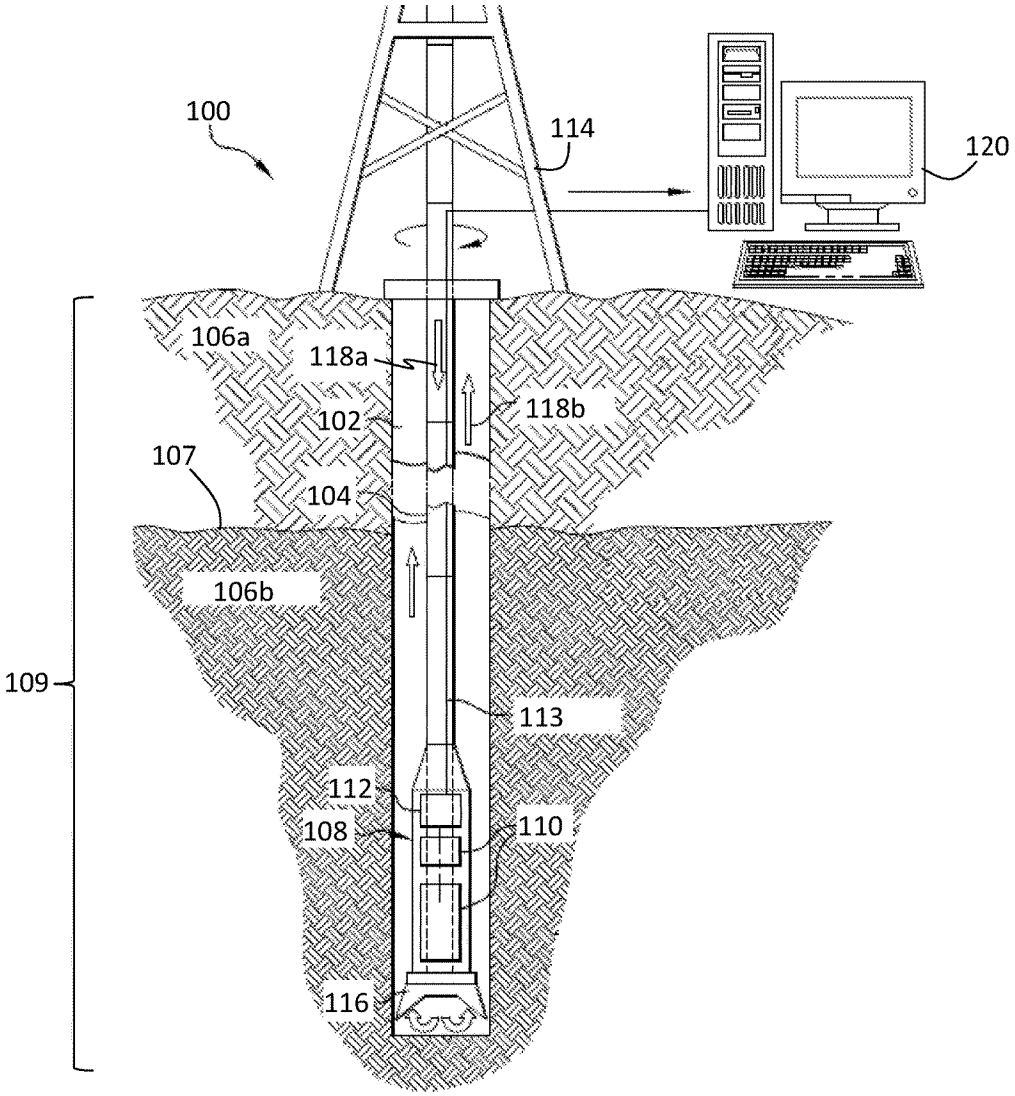
FIG. 1 is a schematic illustration of an embodiment of a drilling system in accordance with an embodiment of the present disclosure.

Referring to FIG. 1, a non-limiting schematic illustration of a drilling system 100 associated with a borehole 102 is shown. A drillstring 104 is run in the borehole 102, which penetrates one or more earth formations 106*a*, 106*b*. The drillstring 104 includes any of various components to facilitate subterranean operations. In various embodiments, the drillstring 104 is constructed of, for example, pipe, drill pipe, coiled tubing, multiple pipe sections, wired pipe, flexible tubing, or other structures. The drillstring 104 is configured to include, for example, a bottom-hole assembly (BHA) on a downhole end thereof. The BHA can be configured for drilling operations, milling operations, measurement-after-drilling pass operations. Further, as will be appreciated by those of skill in the art, sections of the drillstring 104 can include various features, components, and/or configurations, without departing from the scope of the present disclosure. For example, in a non-limiting example, the drillstring 104 can include heavy-weight drill pipe, push pipe, etc.

The system 100 and/or the drillstring 104 may include any number of downhole tools 108 for various processes including measuring drilling vibrations, directional drilling information, and formation evaluation sensors and/or instruments for measuring one or more physical properties, characteristics, quantities, etc. in and/or around the borehole 102. For example, in some embodiments, the downhole tools 108 include a drilling assembly. Various measurement tools can be incorporated into the system 100 to affect measurement regimes such as measurement-while-drilling (MWD), and/or logging-while-drilling (LWD) applications.

While the system 100 may operate in any subsurface environment, FIG. 1 shows the downhole tools 108 disposed in the borehole 102 penetrating the earth 109 (including a first formation 106*a* and a second formation 106*b*). The downhole tools 108 are disposed in the borehole 102 at a distal end of the drillstring 104. As shown, the downhole tools 108 include measurement tools 110 and downhole electronics 112 configured to perform one or more types of measurements in LWD or MWD applications and/or operations. The measurements may include measurements related to drill string operation, for example.

A drilling rig 114 is configured to conduct drilling operations such as rotating the drillstring 104 (e.g., a drill string) and, thus, a drill bit 116 located on the distal end of the drillstring 104. As shown, the drilling rig 114 is configured to pump drilling fluid 118*a* through the drillstring 104 in order to lubricate the drill bit 116. The drilling fluid 118*a* becomes a flushing fluid 118*b* to flush cuttings from the borehole 102.

The downhole electronics 112 are configured generate data, i.e., collect data, at the downhole tools 108. Raw data and/or information processed by the downhole electronics 112 may be telemetered along telemetry 113 to the surface for additional processing or display by a computing system 120. Telemetry may include mud pulse in a fluid column inside the drillstring 104, acoustic transmission in a wall of the drillstring 104, transmission along wires located within the drillstring 104, electromagnetic transmission through the formations 106*a*, 106*b*, and/or any other means of conveying information between downhole and surface. In some configurations, drilling control signals are generated by the computing system 120 and conveyed downhole to the downhole tools 108 or, in alternative configurations, are generated within the downhole electronics 112 or by a combination thereof. The downhole electronics 112 and the computing system 120 may each include one or more processors and one or more memory devices.

Different layers or formations of the earth 109 may each have a unique resistivity, acoustic properties, nuclear properties, etc. For example, the first formation 106*a* may have a first resistivity and the second formation 106*b* may have a second resistivity. Depending on the compositions of the first formation 106*a* and the second formation 106*b*, the first resistivity may be different from the second resistivity. In order to measure and/or detect these resistivities, and thus extract information regarding the formations 106*a*, 106*b*, and/or the interface 107 therebetween, the downhole tools 108 are configured to obtain electromagnetic information. Accordingly, the downhole tools 108 include one or more transmitters (transmitter coils) that turn a current impulse in a transmitter coil on and off to induce a current in the earth 109 (e.g., formations 106*a*, 106*b*). One or more receivers are be configured to receive a resulting transient electromagnetic (TEM) signal. Those of skill in the art will appreciate that the transmitter(s) and receiver(s) may be one-, two-, or tri-axis devices, and/or other transceiver devices may be employed without departing from the scope of the present disclosure. In some embodiments, the transmitters may be configured with electromagnets and/or switchable permanent magnets to induce currents in the earth 109.

Figure 2:
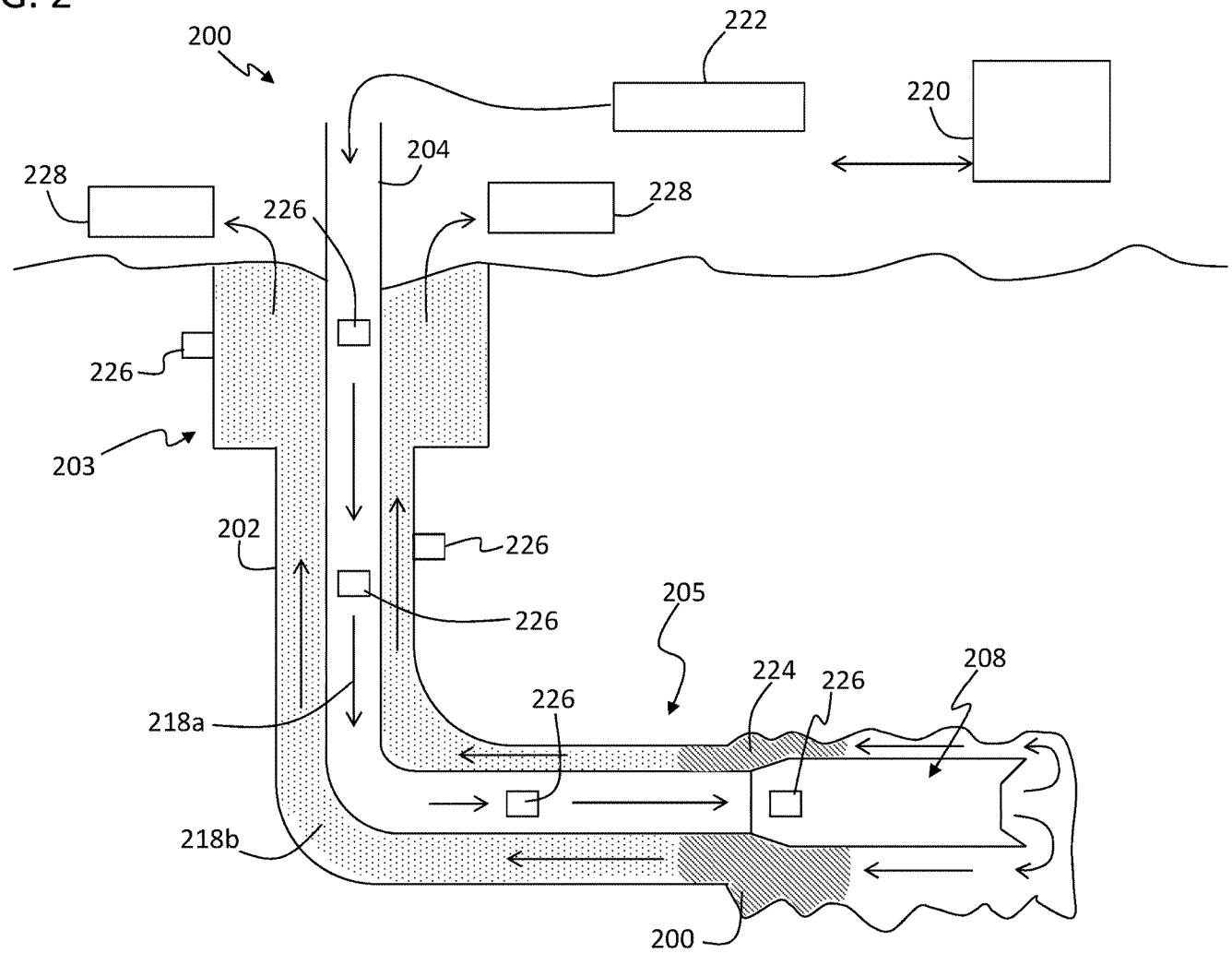
FIG. 2 is a schematic illustration of an embodiment of another downhole drilling, monitoring, evaluation, exploration and/or production system in accordance with an embodiment of the present disclosure.

Turning now to FIG. 2, a schematic illustration of a system 200 including downhole tool disposed in the earth in accordance with an embodiment of the present disclosure is shown. The system 200 may include various features shown and described above with respect to FIG. 1, and may be a downhole drilling system. As shown in FIG. 2, a downhole tool 208 includes a drill bit on a distal end thereof and is configured as part of a bottom hole assembly (BHA). The downhole tool 208 is located on the end of a drillstring 204 within a borehole 202. As shown in FIG. 2, the drillstring 204 may extend through a marine riser 203 and includes a horizontal extension or section 205.

During drilling operations using the downhole tool 208, a drilling fluid 218*a* is pumped through the drillstring 204. If a mud motor (not shown) is included in the BHA, then a mud flow can be used to drive the bit of the downhole tool 208. As the bit engages with the material of the earth, cuttings are generated. The cuttings are then carried out of the borehole 202 by the drilling fluid (indicated as flushing fluid 218*b*). Occasionally hole cleaning is carried out to clean or clear an annulus of the borehole 202 to ensure proper fluid flow and drilling operations. For example, hole cleaning may be necessary in horizontal extensions 205 of a borehole 202 because removal of the cuttings may not be as efficient as in a vertical borehole. If the cuttings are not adequately removed, various impacts may be experienced, including, but not limited to pipe sticking, bit wear, slowed drilling, formation fracturing, excessive torque and/or drag on the drillstring 204, difficulties in logging and/or cementing, difficulties in casings landing, etc. Accordingly, a hole cleaning operation enables and/or ensures efficient and effective drilling operations.

One process of hole cleaning is a sweep process of conveying a "pill" through the drillstring, out through the bottom hole assembly (e.g., through the bit), and then through the annulus between the drillstring 204 and a wall of the borehole 202. The pill is a mud or other fluid that has different properties than the drilling fluid. For example, the pill may be a mixture of different materials that provides a viscous fluid that when passed through the annulus of the borehole 202 is configured to remove the cuttings out of the annulus. For example, as shown in FIG. 2, a pill mixing and deployment system 222 is configured at the surface and is configured to inject the pill 224 into the drillstring 204. The pill mixing and deployment system 222 can include sources of various materials to be mixed to make the pill 224 and further include pumps and/or other injection devices and/or components to drive the pill 224 into the drillstring 204 and then through the annulus within the borehole 202. As shown in FIG. 2, the pill 224 is located near the downhole tool 208 in the annulus of the borehole 202. The arrows of FIG. 2 show the flow path of the pill 224 through the drillstring 204 and then up through the annulus of the borehole 202. Although described herein as a cleaning process, those of skill in the art will appreciate that embodiments provided herein can be applied and used with any type of sweep/pill process.

In some embodiments, the pill may not be pumped completely through the borehole and/or drillstring. For example, in some non-limiting embodiments, a partial sweep may be performed wherein the pill is conveyed to a specific location or area within the drillstring and/or the borehole and then stopped and kept stationary. In such embodiments, the pill can be maintained in a specific position or location by use of acid, cementing, or other means and/or mechanisms. Further, in such embodiments, monitoring of the pill and process can involve monitoring the placement accuracy of the pill and potentially monitoring subsequent features after the pill is secured in the stationary position.

Sweeps of pills through drilling bottom hole assemblies and up the annulus such as for hole cleaning are traditionally triggered and performed manually. However, it would be advantageous to automate the hole pill/sweep process. Specifically, it may be advantageous to automatically identify when a sweep is needed and when such a sweep is possible, then automatically actuating the release of the pill into the system to perform the sweep. Embodiments provided herein are directed to automating the sweep/pill process. Moreover, embodiments provided herein can be configured to verify the sweep during the sweep/pill process and determine if the sweep achieves its objective. Various embodiments provided herein may include a closed loop with actuating controls, such as, for revolutions per minute, weight on bit, axial movement of the drillstring or string, backpressure in a managed pressure drilling application, and/or opening or closing of downhole valves. Advantageously, embodiments provided herein enable automation and automated feedback loops to improve overall performance and reduce risk during drilling operations and/or other downhole operations and processes.

As shown in FIG. 2, the location and progress of the pill 224 as it passes through the drillstring 204 and into the borehole 202 can be monitored by one or more sensors 226. One or more sensors 226 can be disposed on the drillstring 204, one or more sensors 226 can be disposed on the downhole tools 208, one or more sensors 226 can be located within or on a casing of the borehole 202, and one or more sensors 226 can be located about a marine riser 203 or other locations. The sensors 226, in some embodiments, are configured to measure fluid viscosity, fluid flow, fluid density, fluid pressure, or other characteristics of fluids that are proximate to the sensor 226. Further, non-limiting examples of potential monitored characteristics can include pressure, vibrations of the string or one or more tools (e.g., string vibration can be sensed as a function of fluid), torque, axial load, viscosity, resistivity, etc. Thus the sensors 226 can monitor the drilling fluid within the drillstring 204, within the downhole tools 208, and/or within the annulus of the borehole 202.

At the surface, the flushing fluid 218*b* and/or the pill 224 (when it exits the borehole 202) can be analyzed and/or monitored within one or more monitoring devices 228. Similar to the sensors 226, the monitoring devices 228 can be configured to measure fluid viscosity, fluid flow, fluid density, fluid pressure, or other characteristics of fluids and/or materials that are flushed or pushed through the borehole 202 by the pill 224.

The sensors 226 and/or the monitoring devices 228 can be configured in communication to a controller or other computer system 220 (e.g., similar to computing system 120 of FIG. 1). The computer system 220 can be configured with a program or other application that is configured to receive data and/or information from the sensors 226, the monitoring devices 228, and/or other sensors, devices, feedback devices, etc. that are in communication with the computer system 220. The computer system 220 can monitor surface and downhole conditions to determine if a sweep/pill operation should be conducted, can engage and/or perform the sweep/pill operation, and can monitor the progress of the sweep/pill operation, as described herein.

The computer system 220 evaluates constantly the amount of need for a pill and the current downsides of performing a sweep/pill operation. The evaluation can include both technical and nontechnical perspectives. In some embodiments, the computer system 220 and/or the program/application thereof can be advisory in nature. An advisory program would include notification to operators or other personnel that a sweep/pill operation is recommended based on characteristics that have been detected within the drilling system. The computer system 220 is configured to receive real-time measurements and/or modeled data in order to monitor and make decisions (e.g., advise sweep/pill operation and/or automatically start sweep/pill operation). For example, current Equivalent Circulation Density data can be obtained from the sensors 226 as an indication of current cuttings load as well as projected Equivalent Circulation Density (e.g., modeled) of a proposed pill as well as formation fracture gradients as an indication of risk involved of placing the pill (i.e., performing the sweep/pill operation). Equivalent Circulation Density is a measured annular pressure while circulating, expressed as the density of a fluid column that would result in the measured pressure.

When the pill 224 is deployed (either manually or automatically), both modeling and measurements are used to identify where the pill 224 is and "what it is doing." A high-viscosity pill can, for example, speed up turbines used for downhole electrical power generation to dangerous levels as it passes through the downhole tools 208. The automated system is configured to monitor for such restrictions and is configured to change sweep/pill operation parameters in real-time to account for and/or adjust the process to prevent damage to parts of the drilling system. In this example, the flowrate used to push the pill 224 through the drillstring 204 is reduced while the pill 224 is passing the turbine in the downhole tool 208. In some non-limiting embodiments, the system 200 may also be configured to activate a bypass circulation sub within the BHA 208, which would redirect highly viscous fluids to the annulus rather than through components that may be impacted by the pill passing therethrough.

When sweeping, pressure sensors and other indicators (e.g., sensors 226) measure in real-time indications of hole cleaning effectiveness of the pill 224. The pill 224 will push a heavy load of cuttings, which shows in an Equivalent Circulation Density increase and is also a function of cuttings density, inclination, annular cross section, etc. It is impossible for a human to calculate this in real-time to gain an estimated amount of cuttings brought into suspension and/or the rate change of the estimated amount of cuttings. However, advantageously, embodiments provided herein can make such estimates. Accordingly, the system can modify supporting procedures based on the estimates. For example, the computer system 220 can increase revolutions per minute to stir cuttings more, even if that means higher vibration levels, or the other way round. The computer system 220 can also advise on or autonomously perform an optimized axial movement of the bit and pump rate at any given time. Accordingly, embodiments provided herein enable saving time through effective hole cleaning and further can perform additional operations to increase efficiency of borehole cleaning or other sweep/pill operations, including, but not limited to, additional reaming at depths with identified continuing hole cleaning issues.

The computer system 220 can be configured to control pumps, actuators, and/or other controls or devices of system 200 that are configured to control a fluid flow through the drillstring 204 and/or through the borehole 202. The pump rates may automatically be varied depending on where the pill 224 is located within the system 200. For example, the pump rates can be controlled to safely push the pill 224 through the downhole tool 208 and also push the pill 224 through the annulus of the borehole 202. The pump control when the pill 224 is within the annulus may depend, in part, on whether the borehole 202 is an open or cased hole, the inclination of the section of the borehole 202, and/or cross-section of the borehole 202. Further, embodiments provided herein can use information obtained from sensors 226 to identify, quantify, and localize issues that may not be resolved from a sweep/pill operation, after the pill 224 passes the particular section of the drillstring 204 or the particular section of the borehole 202. Accordingly, advantageously, embodiments provided herein can reduce non-production time and increase gross rate of penetration and/or drill rate.

The computer system 220 can also provide guidance or suggestions regarding the composition and/or properties of the pill 224 to be mixed by that pill mixing and deployment system 222. For example, the pill composition may be dependent on issues identified by the one or more sensors 226. Further, the computer system 220 can control the pill mixing and deployment system 222 to automatically mix and/or form the pill 224 prior to injection and/or deployment. The computer system 220 and the pill mixing and deployment system 222 can be used to control the size of the pill 224, the type of pill (e.g., high viscosity vs. high-viscosity/low-viscosity, etc.), and/or can control the viscosity and/or other properties of the pill 224.

Further, the computer system 220, in combination with the sensors 226 can evaluate revolution per minute ("rpm") needs for hole cleaning, e.g., determining appropriate rpm for keeping a pill 224 in suspension. Further, the computer system 220 can control stabilizers and/or other components to stir up cuttings and/or flushing fluid 218*b* when the pill 224 passes in the annulus of the borehole 202. Additional controls enabled by embodiments provided herein may include determining a frequency, number of repetitions, length, and location of reaming in conjunction with the sweep/pill operation, as well as an axial speed of the string. Further, the computer system 220 may actively manage drilling dysfunctions and trigger or suppress dysfunctions depending on the specific needs of the sweep/pill operation (e.g., depending on whether dysfunctions are desirable or not). Such control may be advantageous for Stick-Slip situations.

Moreover, annular back pressure may be controlled by the computer system 220, e.g. in order to keep Equivalent Circulation Density constant or within predefined limits. Annular backpressure can be important for managed drilling operations where the pressure at the base of a fluid column (e.g., the "bottom pressure") should be maintained relatively constant during drilling operations. Further, cleaning efficiency and location of trouble zones can be verified automatically by the computer system 220 using real-time data from the sensors 226 and/or offset data or modeled information and comparing these sets of data. For example, if modeling suggests that good hole cleaning creates an increase in Equivalent Circulation Density of 0.2 specific gravity and it is actually only 0.1 specific gravity there may be an issue, and the issue can be correlated to well depth when the time is known.

Embodiments provided herein also can enable a verification of the sweep/pill operation. Verification can be achieved by reviewing various parameters. For example, Equivalent Circulation Density as a dependent parameter of Standpipe Pressure and/or downhole pressure sensors (ideally distributed along the string (e.g., some or all of sensors 226)) can be monitored and analyzed for verification. Further, cuttings volume over time evaluation, such as by use of a cuttings catcher can be used to verify the sweep/pill operation. Moreover, identification of cuttings vs cavings can be performed automatically via digital camera and shape recognition software employed on computer system 220. Another option is to monitor torque as an indication of friction coefficient changes due to a clean surface behaving differently than a cuttings bed, by the buoyancy impact of the stirred up cuttings etc.

Verification is provide herein can be used in various ways, including but not limited to, changing parameters including the time spent for certain operations and decision making. Various decision making may include when to change shaker screens (e.g., the pill 224 can overload shaker screen requiring a change to a different mesh screen), determine if another pill is required to solve a particular issue at hand or otherwise identified, determine a maximum rate of penetration allowed for a particular section in an instantaneous or per stand basis, determine if the drillstring or string needs to be pulled out of hole (e.g., because pack off cannot be avoided in the future), determine to switch to a different mud system, and/or determine to ream or not to ream. Further examples include when to turn on booster flow to circulate a sweep/pill through a riser.

The computer system 220, the sensors 226, and/or the monitoring devices 228 can evaluate how many cuttings are in the mud system carried by the pill 224, the distribution of cutting within in the mud at any given time, and the impact of the cutting distribution on Equivalent Circulation Density and pressure window issues.

As will be appreciated by those of skill in the art, embodiments provided herein apply to sweeps for other reasons than hole cleaning and/or cuttings removal. For example, when lost circulation material is pumped into the system 200, pressures and pit levels can identify the effectiveness of the lost circulation material. Further, pump rates can be optimized, so that a lost circulation material reaches a predetermined target in an effective manner. Similarly, stress cage can be applied and the amount of solids not effectively used for the stress cage evaluated. Further, the automation process described herein can be applied when triggering something downhole using the mud as a medium (e.g., ball drops). Moreover, embodiments provided herein are not limited to drilling bottom hole assemblies. For example, embodiments provided herein can be applied to production strings and other strings and/or drillstrings and/or other applications including, but not limited to, operations such as while running steerables drilling liners (SDL) or casing while drilling (CWD) strings, in which case completions equipment is run in the hole while drilling. Further, the pill may be used for cleanup prior to pulling out the string dry.

Figure 3:
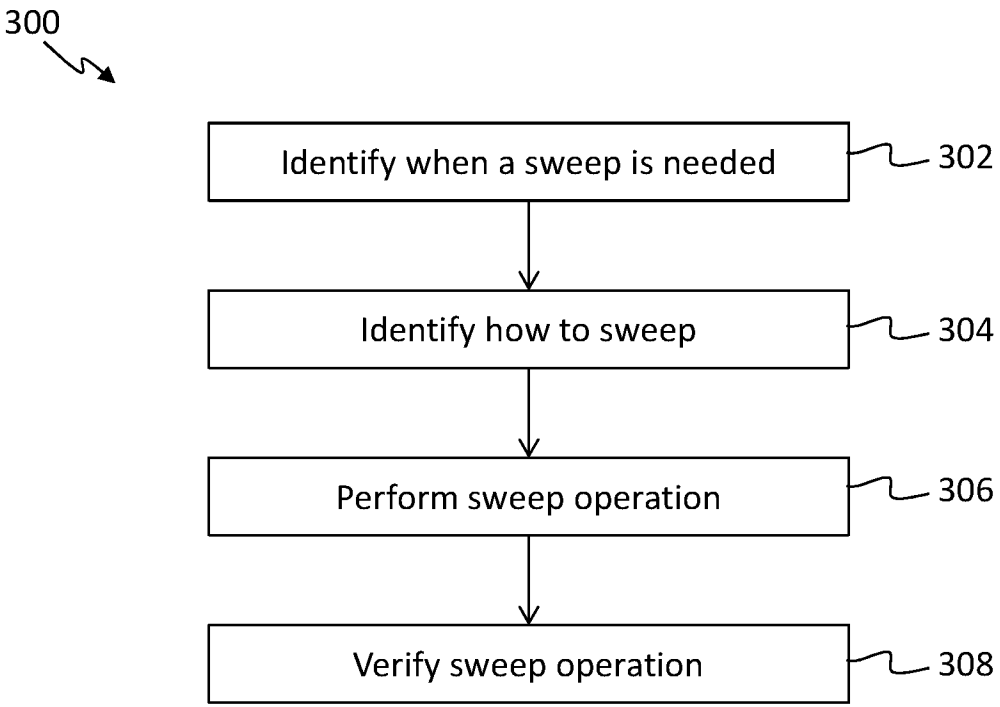
FIG. 3 is a flow process for automatic sweep operation in accordance with an embodiment of the present disclosure.

Turning now to FIG. 3, a flow process in accordance with an embodiment of the present disclosure is shown. The flow process 300 can be performed by a system having downhole components, control components, etc. similar to that discussed above with respect to FIGS. 1-2. The flow process 300, and/or parts thereof, can be performed by a computer system that is operably connected and in communication with one or more downhole components, downhole sensors, surface components, and/or surface sensors. Those of skill in the art will appreciate that the various steps of process 300 may be performed in various order and further additional steps may be included without departing from the scope of the disclosure. Further, various of the steps may be omitted and in other embodiments, each of the steps may include one or more sub-steps, for example, as described below.

At block 302, the system will determine and/or identify when a sweep is needed. A sweep is a process or operation of injecting a pill into a drillstring, conveying the pill through the drillstring, passing the pill from the drillstring into an annulus of a borehole, and then conveying the pill through the annulus back to the surface. The pill, as described above, can be a fluid volume that has a viscosity or other characteristic that is configured to push through the various components of the system, thus providing cleaning or other actions.

The determination process of block 302 may include determining when a sweep is needed or recommended and determining when a sweep is possible. With respect to determining when a sweep is needed, the system may be configured to monitor Equivalent Circulation Density of the system and if the Equivalent Circulation Density is too high (e.g., above a predetermined value or threshold) a sweep may be called for. For example, it may be determined that the system is near a fracture gradient or a suspect pack off is in progress. Further, the system may determine that a sweep is needed before running screens and/or completions.

Further, the determination process of block 302 can include determining when a sweep operation should be performed. For example, Equivalent Circulation Density window modeling verses expected Equivalent Circulation Density can be monitored to determine that a sweep operation can be performed or not. The process can further includes determining that a sweep operation should not be performed during hard stringer drilling where high Equivalent Circulation Density reduced effective weight on bit and/or rate of penetration. Sweep operations can be performed when the pill is confirmed to be mixed and/or when sand pits are not full.

At block 304, the system determines how the sweep will be performed. The system can determine the properties of the sweep including pill characteristics, pump rates, revolutions per minute, axial movement of drillstring/string, management of drilling dysfunctions, and/or regulating annular back pressure (managed pressure drilling). For example, the system may determine the property needs and/or size of the pill. The system may control the mixing and generation of the pill to control or determine the viscosity of the pill and/or other properties so that the pill can be automatically customized to the specific system, borehole, and/or other issues or characteristics of the system.

Further, the system can plan driving pump rates of the system for when the pill is deployed into the system. For example, the computer system can determine pump rates for when the pill is inside the drillstring/string, when the pill is in the annulus (open hole or cased hole), when the pill is located at different hole inclinations, when the pill is located at different hole cross-sections, and/or when the pill will cross the turbine, the drilling motor, and/or other components of the bottom hole assembly or other downhole tools.

Additionally, at block 304, the system can predetermine the driven revolutions per minute for example when the pill is used and stirring of cuttings is desired and/or to keep cuttings in suspension to enable effective cuttings removal. Further, axial movement of the drillstring/string can be predetermined by the system, such as for measured depth distribution of reaming and/or axial speed distribution. Moreover, as noted, the system may provide management of drilling dysfunctions, determining if such actions are desirable or not, whether there is stick-slip, or other types of dysfunctions.

Once it has been determined that a sweep is needed (block 302) and how such a sweep should be performed (block 304), at block 306, the sweep is performed. The mixing of the pill and the deployment thereof can be automated or manual. If manual, the system will provide a notification that the sweep should be performed and can further provide information regarding the recommended composition of the pill and/or suggested actions and/or driving parameters to conduct the sweep/pill operation. Alternatively, the system may automatically actuate and perform the sweep/pill operation. The system may start by mixing and forming the predefined pill (defined at block 304) and then can control the various components of the system to deploy the pill into the drillstring and then drive the pill through the system to perform the sweep operation.

Various configurations of mixed automation and manual operation are considered as well, such as automatically mixing the pill, but then manual deployment and control of the system. Further, different levels of automation can be employed with embodiments of the present disclosure. For example, automatic advisory systems can be used to generate recommendations to be presented to an operator of the drilling system, automatic closed-loop control systems can b used, and autonomous systems are enabled that operate without direct human control.

At block 308, the sweep is verified. Various components of the verification performed at block 308 can be carried out during the sweep operation and/or after completion of the sweep operation carried out at block 306. Verification can be used to identify a cleaning efficiency (e.g., monitor cuttings distribution cleared from borehole) and/or used to verify cleaning or other action at an identified trouble or issue zone either within the drillstring, the downhole tools, and/or within the borehole.

Verification can be performed using collected data from one or more sensors in the drillstring, the downhole tools, and/or the borehole, or a monitoring device located at the surface or within the borehole. Data source timing may be obtained in real time, in real time with a lag time, and/or with respect to an offset well and/or section of well. The data obtained can be compared to offset data, modeled data, and/or zeroed data (e.g., cuttings load on shakers, etc.).

Further, verification at block 308 can include various parameter monitoring. For example Equivalent Circulation Density can be monitored, such as through stand pipe pressure, downhole pressure sensors, Equivalent Circulation Density distribution, and/or over time (vs. inclination and cross-section of hole at location of pill), etc. Other parameters can include cuttings volume as a function of time (e.g., at a cuttings catcher) and/or quantitative identification of cuttings versus cavings (e.g., shape recognition using a camera or other device). Moreover, torque can be monitored for verification of the sweep, including, but not limited to, fa friction coefficient impact of stirred up cuttings, a friction coefficient impact of clean surface versus cuttings bed, and/or buoyancy impact of stirred up cuttings.

After verification at block 308, additional steps may be performed based on the verification and/or sweep operation. For example, the information obtained from the verification at block 308 can be used to make further decisions in the system. Such decisions can include when to change shaker screens, determination if a second or additional pill is needed (with or without pill characteristic changes), identification of restrictions for drilling parameters (e.g., min flow rates, min rpms, max rate of penetration (instantaneous, average per stand, etc.), etc.), determination that the systems should be pulled out of hole, if reaming should be performed, and/or if the drilling mud should be modified.

The information from the verification at block 308 can further be used for timing, including when to stop circulating out and/or when a pill has passed the bottom hole assembly. Such information is of value in placing a pill at a certain location in the annulus or elsewhere in the circulation system of the drilling system, such as placing a stationary acid pill, lacing cement, and/or spacer fluids with the cement, etc. Moreover, verification information can be used for identifying stirred up cuttings, including location and distribution.

Those of skill in the art will appreciate that adjustments of an operation similar to that of flow process 300 can be made to optimize the process. For example, adjusting at least one of at least one of pump rates, revolutions per minute, axial movement of the drillstring, drilling dysfunctions, annular backpressure, or drilling fluid flow path based on the position of the pill, can be carried out. The adjustment may be configured to at least one of keep within a given ECD pressure window, maintain a minimum hole cleaning effectiveness, or prevent damage to or non-function of downhole tools.

Further, those of skill in the art will appreciate that additional and/or other operations can be performed in connection with and/or in tandem with the flow process 300. For example, the flow process 300 can be modified to include automatic triggering of surface or near surface decisions for action, such as timing of shaker screen change-out, choice of shaker screen mesh, turning on or off a booster pump, or connect to mud disposal logistics.

Embodiments provided herein enable automated sweep operations to be performed in drilling or downhole systems. Various embodiments may provide fully automated decision and execution configurations, although partial automated systems are enabled herein. Advantageously, embodiments provided herein may enable less time spent on sweep operations (e.g., less non-production time), improved pill operations (e.g., fewer pills and/or less material used), cleaning can be maximized, identification and/or localization of issues that are not corrected from a sweep can be identified, and consistency is provided herein (i.e., similar sweep operations can be provided and/or optimized sweep operations).

As noted above, those of skill in the art will appreciate that the automated sweep operations provided herein can be used for cleaning or for other purposes. For example, sweep operations as provided herein can be used for lost-circulation material operations, stress cages, triggering a downhole event or action (e.g., ball activation), and/or clean-up prior to pulling out of hole.

Set forth below are some embodiments of the foregoing disclosure:

Embodiment 1

A method for automatically performing a sweep operation in a borehole penetrating an earth formation, the method comprising: conveying a drillstring through a borehole, the drillstring having one or more sensors located thereon; determining that a sweep operation should be performed based on information obtained from the one or more sensors; determining characteristics of a pill to be used for a sweep operation based on information obtained from the one or more sensors; preparing a pill in accordance with the determined characteristics; deploying the pill into the drillstring and conveying the pill into the drillstring; and monitoring the sweep operation while the pill is within the drillstring and verifying the sweep operation, wherein at least one of the determination that a sweep operation should be performed, the determination of the pill characteristics, or the preparation of the pill is performed automatically.

Embodiment 2

The method of embodiment 1, wherein the characteristics of the pill include at least one of a viscosity, a density, or a size of the pill.

Embodiment 3

The method of any of the preceding embodiments, further comprising determining when a sweep operation can be performed based on information from at least one of (i) the one or more sensors, (ii) a comparison of measurements from the sensors with models, or (iii) a model.

Embodiment 4

The method of any of the preceding embodiments, further comprising controlling at least one of pump rates, revolutions per minute, axial movement of the drillstring, drilling dysfunctions, or annular backpressure when the pill is deployed into the drillstring.

Embodiment 5

The method of any of the preceding embodiments, further comprising monitoring the position of the pill within the drillstring with the one or more sensors.

Embodiment 6

The method of any of the preceding embodiments, further comprising adjusting at least one of at least one of pump rates, revolutions per minute, axial movement of the drillstring, drilling dysfunctions, annular backpressure, or drilling fluid flow path based on the position of the pill, the adjustment configured to at least one of keep within a given ECD pressure window, maintain a minimum hole cleaning effectiveness, or prevent damage to or non-function of downhole tools.

Embodiment 7

The method of any of the preceding embodiments, further comprising providing a notification when it is determined that a sweep operation should be performed.

Embodiment 8

The method of any of the preceding embodiments, further comprising at least one of pulling out of hole, reaming, modifying drilling mud, restricting drilling parameters, preparing and deploying another pill, or change shaker screens based on the verification of the sweep operation.

Embodiment 9

The method of any of the preceding embodiments, further comprising conveying the pill through the borehole and monitoring the sweep operation while the pill is within the borehole.

Embodiment 10

The method of any of the preceding embodiments, wherein deploying the pill into the drill string comprises deploying the pill at a stationary position within one of the drillstring or the borehole.

Embodiment 11

The method of any of the preceding embodiments, further comprising automatically triggering surface or near surface decisions for action, such as timing of shaker screen change-out, choice of shaker screen mesh, turning on or off a booster pump, or connect to mud disposal logistics.

Embodiment 12

The method of any of the preceding embodiments, wherein verification comprises using at least one sensor to monitor a downhole pressure, temperature, torque, or cuttings volume change to verify the sweep operation.

Embodiment 13

A system for automatically performing a sweep operation in a borehole penetrating an earth formation, the system comprising: a drillstring configured to be conveyed through a borehole; at least one sensor located on the drillstring configured to monitor a characteristic of a fluid within the drillstring; and a processor configured to perform a sweep operation, the system configured to: determine that a sweep operation should be performed based on information obtained from the one or more sensors; determine characteristics of a pill to be used for a sweep operation based on information obtained from the one or more sensors; prepare a pill in accordance with the determined characteristics; deploy the pill into the drillstring and conveying the pill into the drillstring; and monitor the sweep operation while the pill is within the drillstring and verifying the sweep operation, wherein at least one of the determination that a sweep operation should be performed, the determination of the pill characteristics, or the preparation of the pill is performed automatically.

Embodiment 14

The system of embodiment 13, wherein the characteristics of the pill include at least one of a viscosity, a density, or a size of the pill.

Embodiment 15

The system of any of the preceding embodiments, the processor further configured to determine when a sweep operation can be performed based on information from the one or more sensors.

Embodiment 16

The system of any of the preceding embodiments, the processor further configured to control at least one of pump rates, revolutions per minute, axial movement of the drillstring, drilling dysfunctions, or annular back pressure when the pill is deployed into the drillstring.

Embodiment 17

The system of any of the preceding embodiments, the processor further configured to monitor the position of the pill within the drillstring with the one or more sensors.

Embodiment 18

The system of any of the preceding embodiments, the processor further configured to provide a notification when it is determined that a sweep operation should be performed.

Embodiment 19

The system of any of the preceding embodiments, the processor further configured to convey the pill through the borehole and monitor the sweep operation while the pill is within the borehole.

Embodiment 20

The system of any of the preceding embodiments, the processor further configured to deploy the pill at a stationary position within one of the drillstring or the borehole.

The systems and methods described herein provide various advantages. For example, embodiments provided herein represent a significant advance in the automatic handling of sweeps/pills. This allows for the reduction of non-production time while drilling a borehole and delivers a quality borehole that can be completed to deliver production.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured. The terms "first" and "second" do not denote a particular order, but are used to distinguish different elements.

The flow diagram depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method for automatically performing a sweep operation in a borehole penetrating an earth formation, the method comprising:

conveying a drillstring through a borehole, the drillstring having one or more sensors located thereon;

determining that the sweep operation should be performed based on information obtained from the one or more sensors;

determining characteristics of a pill to be used for the sweep operation based on information obtained from the one or more sensors;

preparing a pill in accordance with the determined characteristics;

deploying the pill into the drillstring and conveying the pill into the drillstring, while performing the sweep operation; and monitoring the sweep operation while the pill is within the drillstring and verifying the sweep operation, wherein the determination that the sweep operation should be performed, the determination of the pill characteristics, and the preparation of the pill are performed automatically without direct human control.

2. The method of claim 1, wherein the characteristics of the pill include at least one of a viscosity, a density, or a size of the pill.

3. The method of claim 1, further comprising determining when the sweep operation can be performed based on information from at least one of (i) the one or more sensors, (ii) a comparison of measurements from the sensors with models, or (iii) a model.

4. The method of claim 1, further comprising controlling at least one of pump rates, revolutions per minute, axial movement of the drillstring, drilling dysfunctions, or annular backpressure when the pill is deployed into the drillstring.

5. The method of claim 1, further comprising monitoring the position of the pill within the drillstring with the one or more sensors.

6. The method of claim 5, further comprising adjusting at least one of at least one of pump rates, revolutions per minute, axial movement of the drillstring, drilling dysfunctions, annular backpressure, or drilling fluid flow path based on the position of the pill, the adjustment configured to at least one of keep within a given ECD pressure window, maintain a minimum hole cleaning effectiveness, or prevent damage to or non-function of downhole tools.

7. The method of claim 1, further comprising providing a notification when it is determined that the sweep operation should be performed.

8. The method of claim 1, further comprising at least one of pulling out of hole, reaming, modifying drilling mud, restricting drilling parameters, preparing and deploying another pill, or change shaker screens based on the verification of the sweep operation.

9. The method of claim 1, further comprising conveying the pill through the borehole and monitoring the sweep operation while the pill is within the borehole.

10. The method of claim 1, wherein deploying the pill into the drill string comprises deploying the pill at a stationary position within one of the drillstring or the borehole.

11. The method of claim 1, further comprising automatically triggering surface or near surface decisions for action, including at least one of timing of shaker screen change-out, choice of shaker screen mesh, turning on or off a booster pump, and connect to mud disposal logistics.

12. The method of claim 1, wherein verification comprises using at least one sensor to monitor a downhole pressure, temperature, torque, or cuttings volume change to verify the sweep operation.

13. A system for automatically performing a sweep operation in a borehole penetrating an earth formation, the system comprising:

a drillstring configured to be conveyed through a borehole;

at least one sensor located on the drillstring configured to monitor a characteristic of a fluid within the drillstring; and a processor configured to perform the sweep operation, the system configured to:

determine that the sweep operation should be performed based on information obtained from the one or more sensors;

determine characteristics of a pill to be used for the sweep operation based on information obtained from the one or more sensors;

prepare a pill in accordance with the determined characteristics;

deploy the pill into the drillstring and conveying the pill into the drillstring, while performing the sweep operation; and monitor the sweep operation while the pill is within the drillstring and verifying the sweep operation, wherein the determination that the sweep operation should be performed, the determination of the pill characteristics, and the preparation of the pill are performed automatically without direct human control.

14. The system of claim 13, wherein the characteristics of the pill include at least one of a viscosity, a density, or a size of the pill.

15. The system of claim 13, the processor further configured to determine when the sweep operation can be performed based on information from the one or more sensors.

16. The system of claim 13, the processor further configured to control at least one of pump rates, revolutions per minute, axial movement of the drillstring, drilling dysfunctions, or annular back pressure when the pill is deployed into the drillstring.

17. The system of claim 13, the processor further configured to monitor the position of the pill within the drillstring with the one or more sensors.

18. The system of claim 13, the processor further configured to provide a notification when it is determined that the sweep operation should be performed.

19. The system of claim 13, the processor further configured to convey the pill through the borehole and monitor the sweep operation while the pill is within the borehole.

20. The system of claim 13, the processor further configured to deploy the pill at a stationary position within one of the drillstring or the borehole.

* * * * *